US011414296B2

(12) United States Patent
Siikonen et al.

(10) Patent No.: US 11,414,296 B2
(45) Date of Patent: Aug. 16, 2022

(54) MANAGING THE NUMBER OF ACTIVE ELEVATOR CARS IN A MULTI-CAR ELEVATOR SHAFT SYSTEM

(71) Applicant: KONE Corporation, Helsinki (FI)

(72) Inventors: Marja-Liisa Siikonen, Helsinki (FI); Mirko Ruokokoski, Helsinki (FI)

(73) Assignee: KONE CORPORATION, Helsinki (FI)

( * ) Notice: Subject to any disclaimer, the term of this patent is extended or adjusted under 35 U.S.C. 154(b) by 897 days.

(21) Appl. No.: 16/239,200

(22) Filed: Jan. 3, 2019

(65) Prior Publication Data

US 2019/0135579 A1 May 9, 2019

Related U.S. Application Data

(63) Continuation of application No. PCT/FI2016/050557, filed on Aug. 9, 2016.

(51) Int. Cl.
*B66B 1/28* (2006.01)
*B66B 1/24* (2006.01)
(Continued)

(52) U.S. Cl.
CPC ..... *B66B 1/28* (2013.01); *B66B 1/2466* (2013.01); *B66B 5/0018* (2013.01); *B66B 9/003* (2013.01);
(Continued)

(58) Field of Classification Search
CPC ..... B66B 9/00; B66B 9/003; B66B 2201/211; B66B 1/2466; B66B 2201/222;
(Continued)

(56) References Cited

U.S. PATENT DOCUMENTS

2003/0217893 A1 11/2003 Dunser et al.
2006/0011420 A1* 1/2006 Duenser ..... B66B 9/00 187/382
(Continued)

FOREIGN PATENT DOCUMENTS

CN 1721311 A 1/2006
CN 101001802 A 7/2007
(Continued)

OTHER PUBLICATIONS

International Search Report (PCT/ISA/210) issued in PCT/FI2016/050557, dated Dec. 14, 2016.
(Continued)

*Primary Examiner* — Marlon T Fletcher
(74) *Attorney, Agent, or Firm* — Birch, Stewart, Kolasch & Birch, LLP

(57) ABSTRACT

According to an aspect, there is provided a method for determining the number of elevator cars in a two-shaft multi-car elevator system. The method comprises determining the number of active elevator cars N in the two-shaft multi-car elevator system by $$N = \frac{RTT * arr}{a * carsize},$$

wherein RTT is a round trip time of the two-shaft multi-car elevator system, arr is the arrival rate of passengers, a is a car load factor, and carsize is the number of passengers one elevator car is able to carry.

18 Claims, 5 Drawing Sheets

(51) Int. Cl.
*B66B 5/00* (2006.01)
*B66B 9/00* (2006.01)

(52) U.S. Cl.
CPC ..... *B66B 2201/242* (2013.01); *B66B 2201/30* (2013.01)

(58) Field of Classification Search
CPC ..... B66B 2201/403; B66B 5/0018; B66B 11/0095; B66B 5/0012; B66B 2201/301; B66B 2201/402; B66B 1/20; B66B 2201/215; B66B 1/3476; B66B 2201/214; B66B 5/0006; B66B 2201/243; B66B 2201/226; B66B 17/20; B66B 1/28
See application file for complete search history.

(56) References Cited

U.S. PATENT DOCUMENTS

| | | | |
|---|---|---|---|
| 2008/0221938 | A1 | 9/2008 | Hikita |
| 2012/0279807 | A1 | 11/2012 | Finschi et al. |
| 2016/0210376 | A1 | 7/2016 | Suzuki |

FOREIGN PATENT DOCUMENTS

| | | | | | |
|---|---|---|---|---|---|
| CN | 101565139 | A | | 10/2009 | |
| CN | 102345404 | A | * | 2/2012 | |
| CN | 104310164 | A | * | 1/2015 | ..... B66B 1/34 |
| CN | 105398890 | A | | 3/2016 | |
| CN | 106029541 | A | * | 10/2016 | ..... B66B 1/2466 |
| CN | 211496525 | U | * | 9/2020 | |
| CN | 113003328 | A | * | 6/2021 | ..... B66B 1/2458 |
| DE | 102018213575 | A1 | * | 2/2020 | ..... B66B 1/2433 |
| EP | 1616832 | A2 | * | 1/2006 | ..... B66B 9/00 |
| JP | 06271214 | A | * | 9/1994 | |
| JP | H06271214 | A | * | 9/1994 | |
| JP | 2012-106849 | A | | 6/2012 | |
| SG | 191514 | A1 | | 7/2013 | |
| WO | WO 97/19879 | A1 | | 6/1997 | |
| WO | WO-2004113216 | A2 | * | 12/2004 | ..... B66B 1/2458 |
| WO | WO 2013/182739 | A1 | | 12/2013 | |
| WO | WO-2016058940 | A1 | * | 4/2016 | ..... B66B 1/2466 |
| WO | WO-2016135090 | A1 | * | 9/2016 | ..... B66B 1/2466 |
| WO | WO-2017005575 | A1 | * | 1/2017 | ..... B66B 1/2466 |
| WO | WO-2018029394 | A1 | * | 2/2018 | ..... B66B 1/2466 |
| WO | WO-2018050947 | A1 | * | 3/2018 | ..... B66B 1/2466 |
| WO | WO-2019143215 | A1 | * | 7/2019 | ..... B66B 11/0075 |

OTHER PUBLICATIONS

Siikonen, "Customer Service in an elevator System During Up-Peak," Transpn Res.-B, vol. 31, No. 2, pp. 127-139, 1997.
Written Opinion of the International Searching Authority (PCT/ISA/237) issued in PCT/FI2016/050557, dated Dec. 14, 2016.
Chinese Office Action and Search Report for Chinese Application No. 201680087777.3, dated Aug. 14, 2020, with English translation.
Ye, "Fundamentals of Elevator Technology," China Electric Power Press, Jun. 2004, pp. 173-177 (14 pages total).

* cited by examiner

MANAGING THE NUMBER OF ACTIVE ELEVATOR CARS IN A MULTI-CAR ELEVATOR SHAFT SYSTEM

BACKGROUND

In a multi-car elevator shaft system, two or more cars move in two elevator shafts independently, always in the same direction in one shaft, and change the shaft on the bottom and the top floor. In other words, the cars move upwards in one shaft and downwards in another shaft, and never move towards each other. A control system of the multi-car elevator shaft system assigns and dispatches elevator cars to serve landing or destination calls.

The multi-car elevator system has to be dimensioned so that it is able to handle both low and high traffic situations. Thus, one of the challenges of operating the multi-car elevator system is how to optimize the number of active elevator cars, i.e. the number of elevator car currently in use.

SUMMARY

According to a first aspect of the invention, there is provided a method for determining the number of elevator cars in a two-shaft multi-car elevator system. The method comprises determining the number of active elevator cars N in the two-shaft multi-car elevator system by $$N = \frac{RTT * arr}{a * carsize},$$

wherein RTT is a round trip time of the two-shaft multi-car elevator system, arr is the arrival rate of passengers, a is a car load factor, and carsize is the number of passengers one elevator car is able to carry.

In one embodiment, the method further comprises determining the arrival rate of passengers with at least one of elevator car load weighing devices, photocells and door light ray systems.

In one embodiment, alternatively or in addition, the method further comprises determining the arrival rate based on traffic forecast data.

In one embodiment, alternatively or in addition, the method further comprises determining the round trip time in real-time with elevator control logic.

In one embodiment, alternatively or in addition, the value of the car load factor is approximately 0.8.

According to a second aspect of the invention, there is provided an apparatus for managing elevator cars in a multi-car elevator shaft system. The apparatus comprises means for determining the number of active elevator cars N in the two-shaft multi-car elevator system by $$N = \frac{RTT * arr}{a * carsize},$$

wherein RTT is a round trip time of the two-shaft multi-car elevator system, arr is the arrival rate of passengers, a is a car load factor, and carsize is the number of passengers one elevator car is able to carry.

In one embodiment, the apparatus further comprises means for determining the arrival rate of passengers with at least one of elevator car load weighing devices, photocells and door light ray systems.

In one embodiment, alternatively or in addition, the apparatus further comprises means for determining the arrival rate based on traffic forecast data.

In one embodiment, alternatively or in addition, the apparatus further comprises means for determining the round trip time in real-time with elevator control logic.

In one embodiment, alternatively or in addition, the value of the car load factor is approximately 0.8.

According to a third aspect of the invention, there is provided a computer program comprising program code, which when executed by at least one processing unit, causes the at least one processing unit to perform the method of the first aspect.

In one embodiment, the computer program is embodied on a computer readable medium.

According to a fourth aspect of the invention, there is provided an elevator system comprising two elevator shafts, wherein the elevator shafts are connected to each other and wherein elevator cars are configured to move upwards in a first elevator shaft and downwards in a second elevator shaft, and an apparatus of the second aspect.

According to a fifth aspect of the invention, there is provided an apparatus for managing elevator cars in a multi-car elevator shaft system. The apparatus comprises at least one processor and at least one memory connected to the at least one processor. The at least one memory stores program instructions that, when executed by the at least one processor, cause the apparatus to determine the number of active elevator cars N in the two-shaft multi-car elevator system by $$N = \frac{RTT * arr}{a * carsize},$$

wherein RTT is a round trip time of the two-shaft multi-car elevator system, arr is the arrival rate of passengers, a is a car load factor, and carsize is the number of passengers one elevator car is able to carry. The means disclosed above may be implemented using at least one processor or at least one processor and at least one memory connected to the at least one processor, the memory storing program instructions to be executed by the at least one processor.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
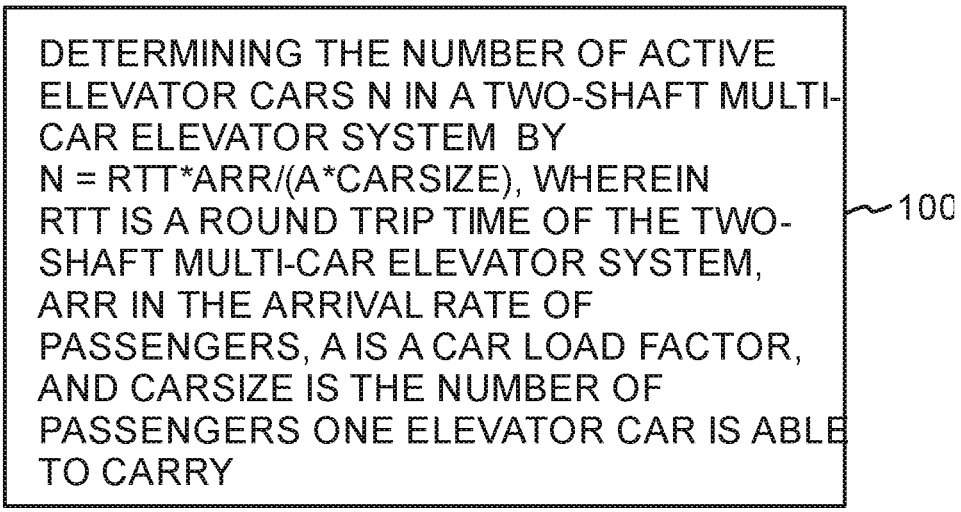
FIG. 1 is a flow diagram illustrating a method for managing elevator cars in a multi-car elevator shaft system according to one embodiment.

FIG. 1 is a flow diagram illustrating a method for determining the number of elevator cars in a two-shaft multi-car elevator system according to one embodiment. In the multi-car elevator shaft system, two or more cars move in two elevator shafts independently, always in the same direction in one shaft, and change the shaft, for example, on the bottom and the top floor. In other words, the cars move upwards in one shaft and downwards in another shaft, and never move towards each other. A control system of the multi-car elevator shaft system assigns and dispatches elevator cars to serve landing or destination calls.

The multi-car elevator shaft system comprises at least one elevator car storage. Elevator cars in the at least one elevator car storage act as standby elevator cars for the multi-car elevator shaft system.

At 100 the number of active elevator cars N in the two-shaft multi-car elevator system is determined by $$N = \frac{RTT * arr}{a * carsize},$$

wherein

RTT is a round trip time of the two-shaft multi-car elevator system, arr is the arrival rate of passengers, a is a car load factor, and carsize is the number of passengers one elevator car is able to carry, for example, the rated load of one elevator car.

The parameter a is a factor, which typically has the value 0.80. Thus, a*carsize tells a typical degree of fullness of an elevator car as typically an elevator car is not fully loaded to its rated load. The arrival rate may be expressed, for example, as persons/second or persons/five minutes.

If the formula for determining for the number of active elevator cars does not yield a whole number, the result can be rounded up or down to the next or previous whole number. In one embodiment, the result is rounded to the nearest whole number. In another embodiment, the result is always rounded up to the next whole number if the result does not yield a whole number.

The arrival rate of passengers may be determined, for example, with at least one of elevator car load weighing devices, photocells and door light ray systems. The arrival rate of passengers may also be determined based on traffic forecast data. If traffic forecast data is used, this enables anticipating the moment of time when it is necessary to decrease/increase the amount of elevator cars. Further, if it takes a certain amount of time to take a new car into use or remove an active car from use, this transition time may also be taken into account when determining the number of active elevator cars N in the two-shaft multi-car elevator system. In one embodiment, both the real-time information and the traffic forecast data relating to the arrival rate may be used to determine the arrival rate of passengers. For example, the real-time measurement of the arrival rate of passengers may provide verification for the traffic forecast data.

In one embodiment, the round trip time may be determined in real-time with elevator control logic. The elevator control logic may continuously calculate the current round trip time. In another embodiment, the round trip time may be calculated using known mathematic formulas. The used formulas may depend on, for example, whether the arrival rate of passengers follows a uniform distribution or a Poisson distribution. Yet in another embodiment, the round trip time can be determined by measuring the time for an elevator car with full load starting its journey from an entrance floor until it again starts from the same entrance floor.

By keeping the amount of elevator cars in service optimum, the amount of energy used by the elevator system is optimized.

Figure 2A:
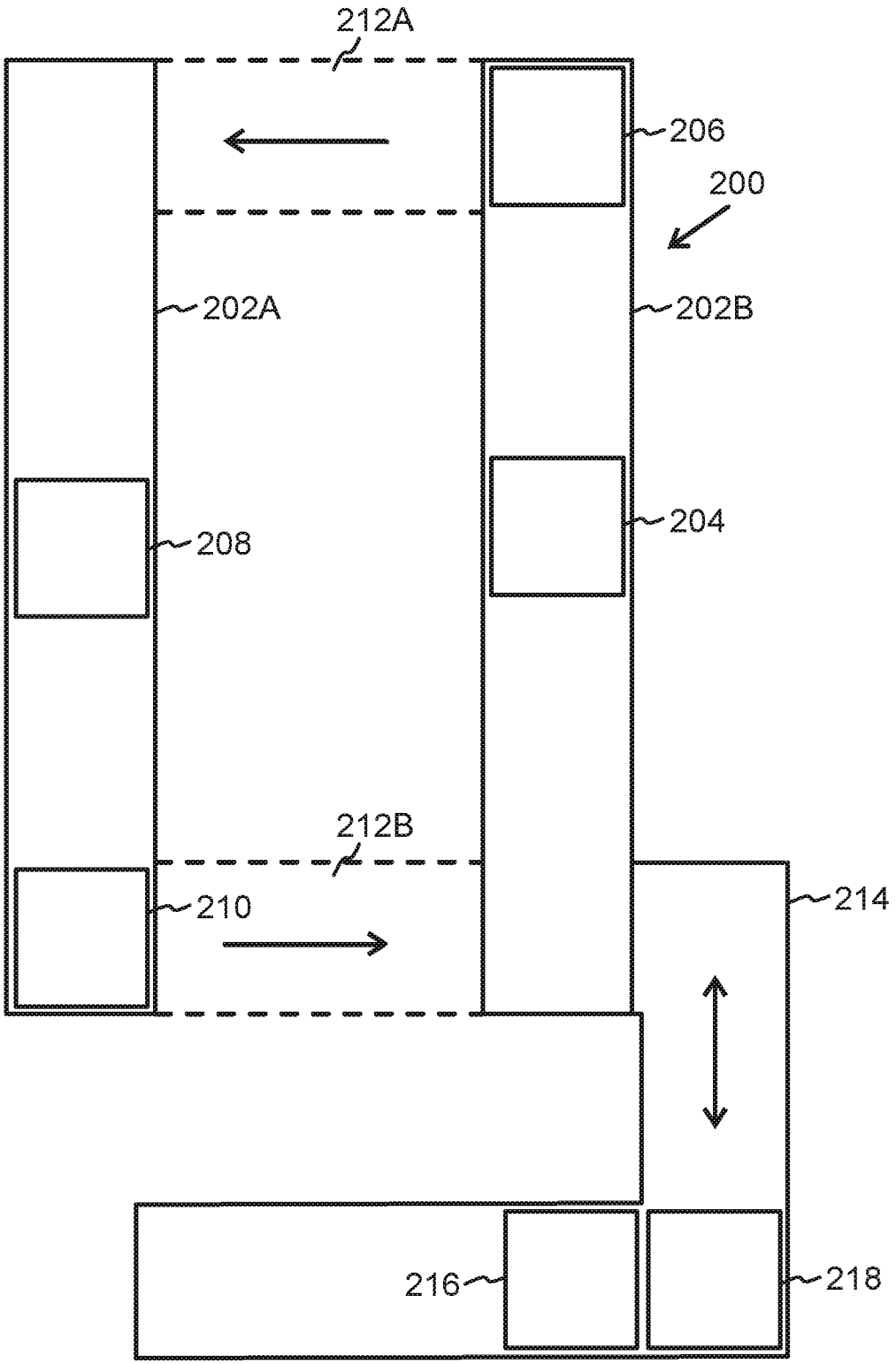
FIG. 2A is system diagram illustrating a multi-car elevator shaft system according to one embodiment.

FIG. 2A is system diagram illustrating a multi-car elevator shaft system 200 according to one embodiment. The multi-car elevator shaft system 200 comprises two elevator shafts 202A, 202B connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft and downwards in another shaft, and never move towards each other. An elevator control entity of the multi-car elevator shaft system assigns and dispatches elevator ears to serve landing or destination calls.

The multi-car elevator shaft system comprises 200 an elevator car storage 214. Elevator cars 216, 218 in the elevator car storage 214 act as standby elevator cars for the multi-car elevator shaft system 200. One or more elevator cars from the elevator car storage 214 can be taken back to service if the traffic situation of the multi-car elevator shaft system 200 calls for it. Similarly, one or more elevator cars may be put back to the elevator car storage 214 if the traffic situation of the multi-car elevator shaft system 200 allows it.

Figure 2B:
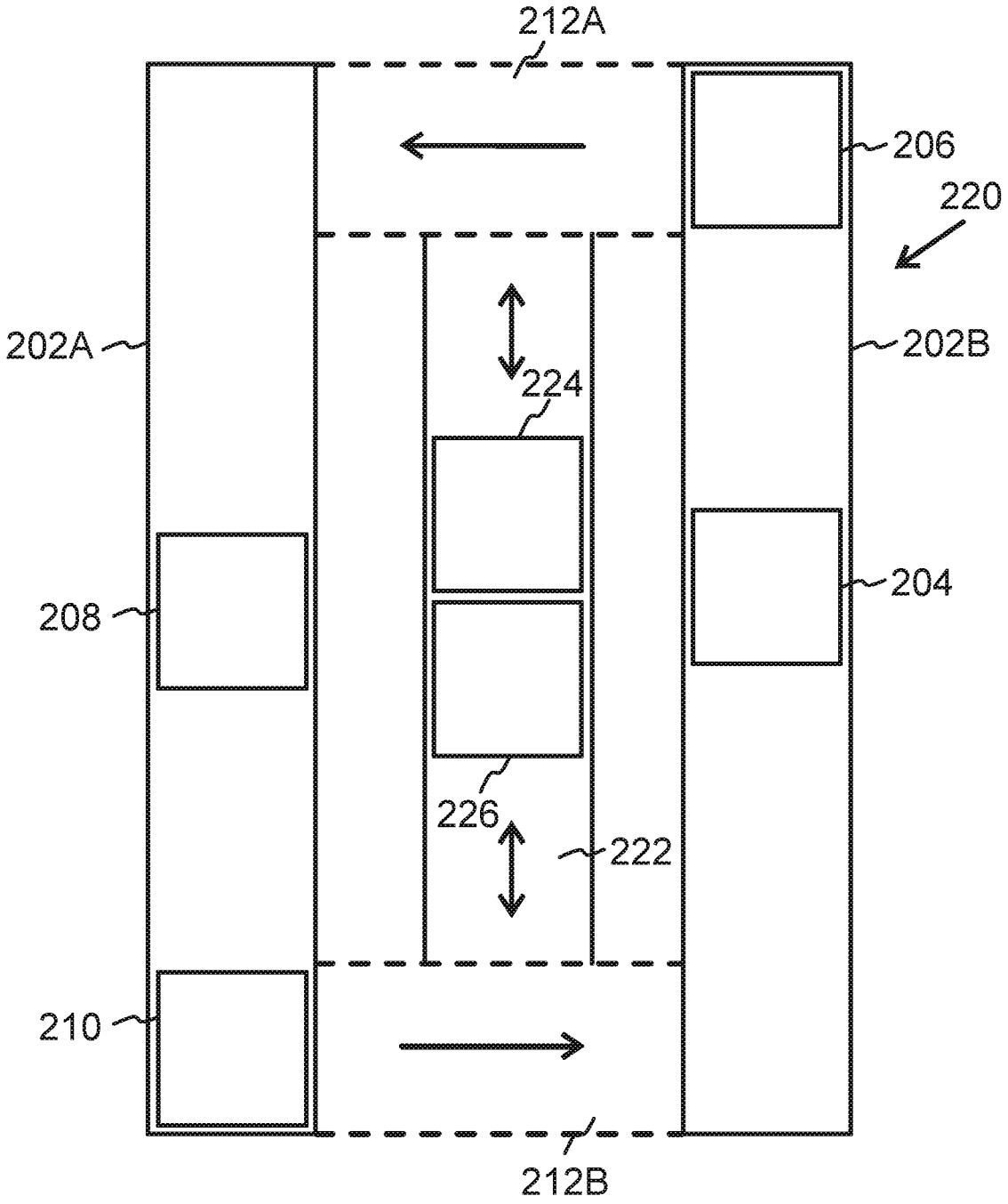
FIG. 2B is system diagram illustrating a multi-car elevator shaft system according to another embodiment.

FIG. 2B is system diagram illustrating a multi-car elevator shaft system 220 according to another embodiment. The multi-car elevator shaft system 220 comprises two elevator shafts 202A, 202B connected to each other via connecting passageways 212A, 212B. Two or more cars 204, 206, 208, 210 move in the elevator shafts 202A, 202B independently, always in the same direction in one shaft, and change the shaft, for example, on the bottom and the top floor. In other words, the cars 204, 206, 208, 210 move upwards in one shaft, and downwards in another shaft, and never move towards each other. An elevator control entity of the multi-car elevator shaft system assigns and dispatches elevator cars to serve landing or destination calls.

The multi-car elevator shaft system 220 comprises an elevator car storage 222. Elevator cars 224, 226 in the elevator car storage 222 act as standby elevator cars for the multi-car elevator shaft system 220. One or more elevator cars from the elevator car storage 224 can be taken back to service if the traffic situation of the multi-car elevator shaft system 200 calls for it. Similarly, one or more elevator cars may be put back to the elevator car storage 222 if the traffic situation of the multi-car elevator shaft system 220 allows it. In this embodiment, the elevator car storage 222 is connected from both of its ends to the connecting passageways 212A, 212B. This allows adding and/or removing elevator cars to/from both ends of the elevator system 220.

Figure 2C:
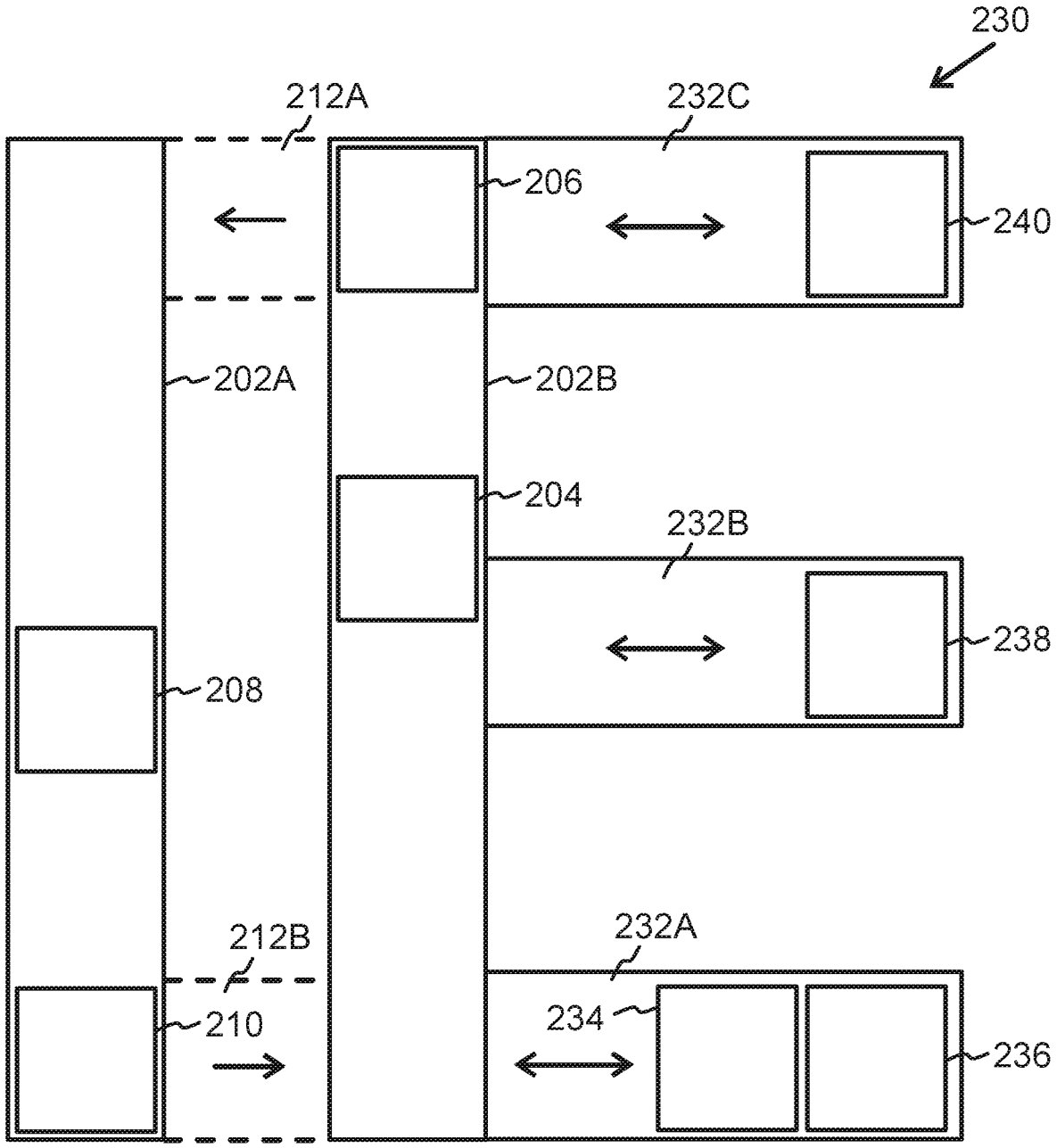
FIG. 2C is system diagram illustrating a multi-car elevator shaft system according to another embodiment.

FIG. 2C is system diagram illustrating a multi-car elevator shaft system 230 according to another embodiment. The multi-car elevator shaft system 230 comprises two elevator shafts 202A, 202B connected to each other via connecting passageways 212A, 212B. Two or more elevator cars 204, 206, 208, 210 move in the elevator shafts 202A, 202B independently, always in the same direction in one shaft, and change the shaft, for example, on the bottom and the top floor. In other words, the elevator cars 204, 206, 208, 210 move upwards in one shaft and downwards in another shaft, and never move towards each other. An elevator control entity of the multi-car elevator shaft system assigns and dispatches elevator cars to serve landing or destination calls.

The multi-car elevator shaft system 230 comprises a separate elevator car storage 232A, 232B, 232C for each floor of the elevator shaft 202B. Elevator cars 234, 236, 238, 240 in the elevator car storages 232A, 232B, 232C act as standby elevator cars for the multi-car elevator shaft system 230. One or more elevator cars from the elevator car storages 232A, 232B, 232C can be taken back to service if the traffic situation of the multi-car elevator shaft system 230 calls for it. Similarly, one or more elevator cars may be put back to any of the elevator car storages 232A, 232B, 232C if the traffic situation of the multi-car elevator shaft system 230 allows it.

Although FIGS. 2A, 2B and 2C illustrate specific embodiments having a certain amount of elevator cars and specific amounts and locations for elevator car storages, also other arrangements and variations are possible.

Figure 3:
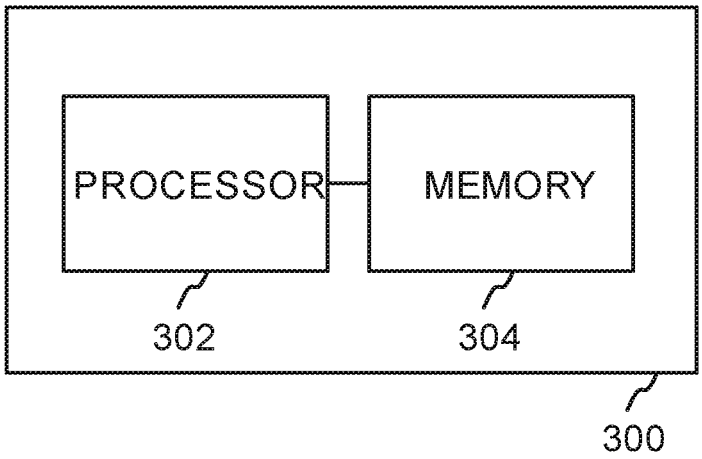
FIG. 3 is a block diagram of an apparatus for managing elevator cars in a multi-car elevator shaft system according to one embodiment.

FIG. 3 is a block diagram illustrating an apparatus 300 for determining the number of elevator cars in a two-shaft multi-car elevator system in accordance with one embodiment. The apparatus 300 comprises at least one processor 302 connected to at least one memory 304. The at least one memory 304 may comprise at least one computer program which, when executed by the processor 302 or processors, causes the apparatus 300 to perform the programmed functionality. The apparatus 300 may be configured to determine the number of active elevator cars N in the two-shaft multi-car elevator system by $$N = \frac{RTT * arr}{a * carsize},$$

wherein

RTT is a round trip time of the two-shaft multi-car elevator system, arr is the arrival rate of passengers, a is a car load factor, and carsize is the number of passengers one elevator car is able to carry.

The apparatus 300 may also comprise input/output ports and/or one or more physical connectors, which can be an Ethernet port, a Universal Serial Bus (USB) port, IEEE 1394 (FireWire) port, and/or RS-232 port. The illustrated components are not required or all-inclusive, as any components can deleted and other components can be added.

The apparatus 300 may be an elevator control entity configured to implement only the above disclosed operating features relating to FIG. 1, or it may be part of a larger elevator control entity.

The processor 302 and the memory 304 may also constitute means for determining the number of active elevator cars N in the two-shaft multi-car elevator system by $$N = \frac{RTT * arr}{a * carsize},$$

wherein

RTT is a round trip time of the two-shaft multi-car elevator system, arr is the arrival rate of passengers, a is a car load factor, and carsize is the number of passengers one elevator car is able to carry.

The exemplary embodiments of the invention can be included within any suitable device, for example, including, servers, work stations, personal computers, laptop computers, capable of performing the processes of the exemplary embodiments. The exemplary embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for determining the number of elevator cars in use in a two-shaft multi-car elevator system, wherein the elevator shafts are connected to each other and wherein the elevator cars are configured to move only upwards in a first elevator shaft among the two elevator shafts and move only downwards in a second elevator shaft among the two elevator shafts, the method comprising:

determining, by a processor of the multi-car elevator system, the number of active elevator cars N in use in the two-shaft multi-car elevator system by $$N = \frac{RTT * arr}{a * carsize},$$

wherein

RTT is a round trip time of the two-shaft multi-car elevator system, arr is the arrival rate of passengers, a is a car load factor, and carsize is the number of passengers one elevator car is able to carry; and taking back to service, by a processor of the multi-car elevator system, one or more elevator cars from an elevator car storage or putting back one or more elevator cars to the elevator car storage depending on the determined number of active elevator cars N, wherein the two-shaft multi-car elevator system further comprises:

a top having only a first connecting passageway;

a bottom having only a second connecting passageway; and at least one elevator car storage separate from the first elevator shaft and the second elevator shaft, and connected to one of the first elevator shaft and the second elevator shaft or connected to both the first connecting passageway and the second connecting passageway.

2. The method of claim 1, further comprising:

determining the arrival rate of passengers with at least one of elevator car load weighing devices, photocells and door light ray systems.

3. The method of claim 1, further comprising:

determining the arrival rate based on traffic forecast data.

4. The method of claim 1, further comprising:

determining the round trip time in real-time with elevator control logic.

5. The method of claim 1, wherein the value of the car load factor approximately 0.8.

6. The method of claim 2, further comprising:

determining the round trip time in real-time with elevator control logic.

7. The method of claim 2, wherein the value of the car load factor approximately 0.8.

8. An elevator system comprising:

two elevator shafts, wherein the elevator shafts are connected to each other and wherein elevator cars are configured to move only upwards in a first elevator shaft among the two elevator shafts and move only downwards in a second elevator shaft among the two elevator shafts; and a processor configured to:

determine the number of active elevator cars N in use in the two-shaft multi-car elevator system by:

$$N = \frac{RTT * arr}{a * carsize},$$

wherein

RTT is a round trip time of the two-shaft multi-car elevator system, arr is the arrival rate of passengers, a is a car load factor, carsize is the number of passengers one elevator car is able to carry, and take back to service one or more elevator cars from an elevator car storage or putting back one or more elevator cars to the elevator car storage depending on the determined number of active elevator cars N, wherein the elevator system further comprises:

a top having only a first connecting passageway:

a bottom having only a second connecting passageway, and at least one elevator car storage separate from the first elevator shaft and the second elevator shaft and connected to one of the first elevator shaft and the second elevator shaft or connected to both the first connecting passageway and the second connecting passageway.

9. The method of claim 4, wherein the value of the car load factor approximately 0.8.

10. The method of claim 1, wherein the at least one elevator car storage is a single elevator car storage connected to the right side of the second connecting passageway.

11. The method of claim 1, wherein the at least one elevator car storage is a single elevator car storage located between the first elevator shaft and the second elevator shaft, and wherein the single elevator car stage is connected to the first connecting passageway and to the second connecting passageway.

12. The method of claim 1, wherein the at least one elevator car storage includes a first elevator car storage, a second elevator car storage, and a third elevator car storage, wherein the first elevator car storage is connected to the first connecting passageway, wherein the second elevator car storage is connected to a middle of the multi-car elevator system and is located below the first elevator car storage, and wherein the third elevator car storage is connected to the second connecting passageway and is located below the second elevator car storage.

13. The elevator system of claim 8, wherein the value of the car load factor approximately 0.8.

14. The elevator system of claim 13, further comprising: determining the arrival rate based on traffic forecast data.

15. The elevator system of claim 13, further comprising: determining the round trip time in real-time with elevator control logic.

16. The elevator system of claim 13, wherein the at least one elevator car storage is a single elevator car storage connected to the right side of the second connecting passageway.

17. The elevator system of claim 13, wherein the at least one elevator car storage is a single elevator car storage located between the first elevator shaft and the second elevator shaft, and wherein the single elevator car stage is connected to the first connecting passageway and to the second connecting passageway.

18. The elevator system of claim 13, wherein the at least one elevator car storage includes a first elevator car storage, a second elevator car storage, and a third elevator car storage, wherein the first elevator car storage is connected to the first connecting passageway, wherein the second elevator car storage is connected to a middle of the elevator system and is located below the first elevator car storage, and wherein the third elevator car storage is connected to the second connecting passageway and is located below the second elevator car storage.

* * * * *